US007721541B2

(12) United States Patent
Roberts, Jr. et al.

(10) Patent No.: US 7,721,541 B2
(45) Date of Patent: May 25, 2010

(54) SECONDARY INTERNAL COMBUSTION DEVICE FOR PROVIDING EXHAUST GAS TO EGR-EQUIPPED ENGINE

(75) Inventors: Charles E. Roberts, Jr., Helotes, TX (US); Rudolf H. Stanglmaier, Fort Collins, CO (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 11/269,101

(22) Filed: Nov. 8, 2005

(65) Prior Publication Data

US 2006/0112940 A1 Jun. 1, 2006

Related U.S. Application Data

(60) Provisional application No. 60/625,837, filed on Nov. 8, 2004.

(51) Int. Cl.
*F02B 33/44* (2006.01)
*F02B 75/18* (2006.01)
*F02B 37/00* (2006.01)
*F02M 25/07* (2006.01)

(52) U.S. Cl. ..... 60/605.2; 123/568.12; 123/568.11; 123/58.8

(58) Field of Classification Search ..... 123/58.8, 123/568.11, 568.12, 52.4, 52.6, 59.6; 60/605.2
See application file for complete search history.

(56) References Cited

U.S. PATENT DOCUMENTS 2,349,967 A * 5/1944 Javal ..... 123/68
3,805,752 A * 4/1974 Cataldo ..... 123/58.8
3,924,576 A * 12/1975 Siewert ..... 123/58.8
3,941,113 A * 3/1976 Baguelin ..... 123/568.11
4,108,114 A * 8/1978 Kosaka et al. ..... 123/58.8
4,131,095 A 12/1978 Ouchi ..... 123/58.8
4,452,208 A * 6/1984 Merlini et al. ..... 123/559.1
4,760,702 A * 8/1988 Ammann et al. ..... 60/605.1
5,007,384 A * 4/1991 Blair ..... 123/70 R
5,178,119 A * 1/1993 Gale ..... 123/568.12
5,456,240 A 10/1995 Kanesaka ..... 123/568.11
5,517,976 A 5/1996 Bachle et al. ..... 123/568.11
5,894,726 A * 4/1999 Monnier ..... 123/568.11
6,009,709 A * 1/2000 Bailey ..... 60/605.2

(Continued)

FOREIGN PATENT DOCUMENTS

JP 11247665 A * 9/1999

(Continued)

OTHER PUBLICATIONS

A Machine Translation JP 11-247665A.*

(Continued)

*Primary Examiner*—Thai Ba Trieu
(74) *Attorney, Agent, or Firm*—Baker Botts LLP

(57) ABSTRACT

A system and method for providing exhaust gas to an EGR-equipped lean burn diesel engine (the primary engine). The exhaust gas is provided by a secondary internal combustion device, whose configuration, thermal cycle, and operating conditions may be different from that of the primary engine. The secondary internal combustion device may receive recirculated exhaust gas, fresh air, or some combination of both.

3 Claims, 3 Drawing Sheets

U.S. PATENT DOCUMENTS

| | | | | |
|---|---|---|---|---|
| 6,286,489 | B1 | 9/2001 | Bailey | 123/568.11 |
| 6,425,381 | B1 * | 7/2002 | Rammer | 123/568.12 |
| 6,484,702 | B1 * | 11/2002 | Riley | 123/568.11 |
| 6,536,392 | B2 | 3/2003 | Widener | 123/179.19 |
| 6,543,398 | B1 * | 4/2003 | Roberts et al. | 123/58.8 |
| 6,789,531 | B1 * | 9/2004 | Remmels | 123/568.11 |
| 7,255,095 | B1 * | 8/2007 | Brevick et al. | 123/568.11 |
| 2002/0189598 | A1 | 12/2002 | Remmels et al. | 123/568.11 |
| 2004/0099256 | A1 * | 5/2004 | Stewart | 123/568.11 |
| 2007/0193270 | A1 * | 8/2007 | Roozenboom et al. | 60/605.2 |

FOREIGN PATENT DOCUMENTS

JP 2008285997 A * 11/2008

OTHER PUBLICATIONS

A Fully Certified English Translation of JP 11-247665A.*

International Search Report with Written Opinion, PCT/US05/40483, 12 pages, Mailed Oct. 2, 2006.

International Preliminary report on Patentability for International Appl. No. PCT/US2005/040483 (8 pages), May 18, 2007.

* cited by examiner

SECONDARY INTERNAL COMBUSTION DEVICE FOR PROVIDING EXHAUST GAS TO EGR-EQUIPPED ENGINE

CROSS-REFERENCE TO RELATED APPLICATIONS

This application claims the benefit of U.S. Provisional Application Ser. No. 60/625,837 filed Nov. 8, 2004, which is incorporated herein by reference in its entirety.

TECHNICAL FIELD OF THE INVENTION

This invention relates to engine exhaust emissions systems, and more particularly to an exhaust gas recirculation (EGR) system comprising a small secondary internal combustion device that delivers exhaust gas to a primary engine that is equipped with an EGR loop.

BACKGROUND OF THE INVENTION

The use of exhaust gas recirculation (EGR) for reducing NOx emissions from internal combustion gasoline engines has been practiced in the automotive industry for over twenty years. More recently, the diesel engine industry has stepped up its development of EGR systems to meet ever-increasing NOx emissions regulations.

External EGR systems are defined as those systems that extract exhaust gas from the engine's exhaust system and then route it, external to the engine's combustion chamber(s), to the engine's fresh air intake system. To create the necessary flow rate of EGR gases, the EGR must be pressurized. One method for pressurizing the EGR is to extract the EGR gas from a high-pressure portion of the exhaust system and deliver it to a lower pressure portion of the engine's air intake system. The relative pressure difference between the extraction location and the delivery location creates the required mass flow rate.

In the automotive industry, where spark-ignited engines are predominant, the pressure at the air intake is low, because the engine's fresh airflow is restricted by an intake throttle. Hence, the intake system pressure is lower than the exhaust pressure for most operating conditions, and EGR flows readily.

In the diesel industry, most modern engines are turbocharged, meaning that the exhaust and intake systems are pressurized. For best fuel efficiency, it is desirable to have intake system pressure higher than exhaust system pressure, commonly termed "positive engine pressure ratio". This creates positive pumping work, derived from the turbocharger's use of waste exhaust heat, thus increasing cycle efficiency. Use of EGR on turbocharged diesel engines has been detrimental to fuel efficiency because the positive pressure ratio across the engine must be reversed, so that a negative pressure gradient is formed to create the necessary EGR flow rate. The final outcome is reduced NOx emissions at the expense of fuel efficiency.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 1 A illustrates the system of FIG. 1 with naturally aspirated intake air to the secondary internal combustion engine.

DETAILED DESCRIPTION OF THE INVENTION

The invention described below is directed to a high efficiency EGR method and system, as applied to reciprocating internal combustion engines. As explained below, the EGR system comprises a secondary (auxiliary or integrated) internal combustion device associated with a primary internal combustion engine. The primary engine may be any type of lean burn engine, two or four stroke. It may, but need not be, turbocharged. The secondary combustion device may be two or four stroke, and may operate at any air-fuel operating condition, i.e., stoichiometric (or near stoichiometric), rich, or lean.

The method and system eliminate the need for a negative engine pressure ratio, thus eliminating the primary efficiency reduction challenge associated with previous EGR techniques. NOx emissions are reduced and fuel economy is maintained.

Figure 1:
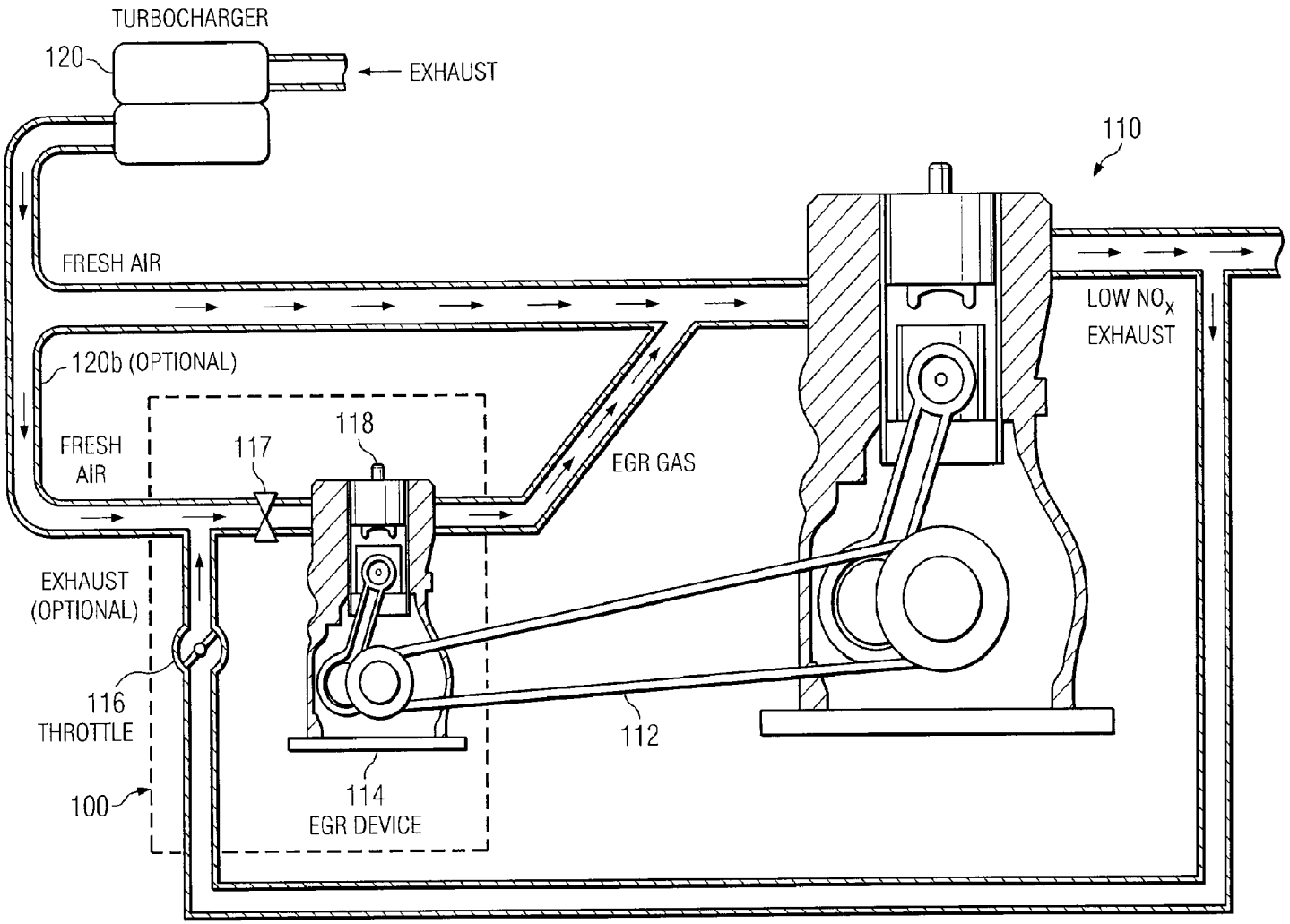
FIG. 1 illustrates one example of an engine having EGR and an auxiliary internal combustion device in accordance with the invention.

FIG. 1 illustrates a first example of an EGR system 100 in accordance with the invention. EGR system 100 transfers EGR system power to the crankshaft of the primary engine 110 through a belt and pulley system 112. As explained below, the EGR device 114 of system 100 is a combustion device that generates exhaust gas for delivery to primary engine 110. This exhaust gas is used by primary engine 110 for reduction of NOx emissions.

The mass flow rate of exhaust gas delivered to the primary engine 110 is controlled by the shaft speed of the EGR-device 114, as well as by modulation of the throttle 116. The composition of the EGR gas is controlled by the fuel delivery means 118 to EGR device 114.

As indicated in FIG. 1, EGR system 100 may intake fresh air only, or it may receive some combination of fresh air and recirculated exhaust gas from engine 110. Valve 117 controls the amount of recirculated exhaust gas. Alternatively, or in addition, exhaust gas could be recirculated from the output of EGR device 114 to its intake (not shown). Regardless of whether or not it receives recirculated exhaust from primary engine 110 or from EGR device 114, EGR system 100 is nonetheless referred to herein as an "EGR system" in the sense that it supplies exhaust gas to primary engine 110.

As stated above, primary engine 110 may be turbocharged. Turbocharger 120 delivers boost (charged) air to the intake of the primary engine 110. Turbocharger 120 may optionally also deliver charged air to the intake of the EGR device 114 via a boost air intake line 120*b* from turbocharger 120. If recirculated exhaust is looped to the intake of EGR device 114, the loop may be either high or low pressure.

In FIG. 1, the EGR system 100 is represented as having a combustion device 114 that is physically separate from the primary engine 110. Alternatively, the EGR device may be integral with one or more cylinders of the primary engine.

Figure 2:
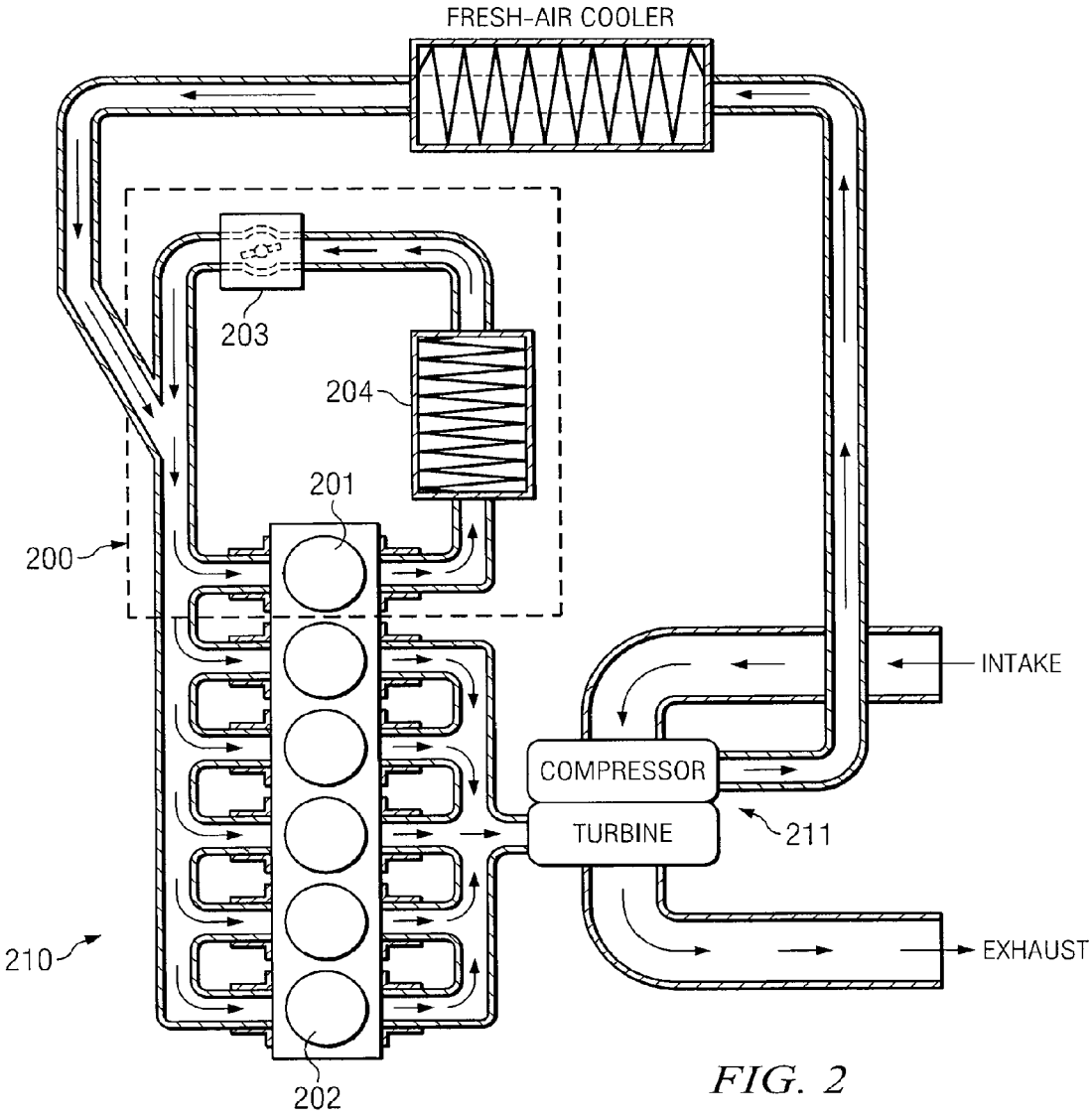
FIG. 2 illustrates a second example of an engine having EGR and an integrated internal combustion device in accordance with the invention.

FIG. 2 illustrates a second example of an EGR system 200 in accordance with the invention. EGR system 200 has an EGR device 201 that is integrated into primary engine 210. In the example of FIG. 2, primary engine 210 is a lean burn, two or four stroke internal combustion engine.

Engine 210 is a multi-cylinder engine having a turbocharger 211. Exhaust gas is produced by EGR device 201 and delivered to cylinders 201 and 202 (and all other cylinders)

via a cooler 204 in a high pressure loop configuration. For purposes of this description, cylinder 201 is an "EGR cylinder" dedicated to the production of EGR gas, with all other cylinders being identified as cylinders 202.

More specifically, system 200 uses a cylinder 201 of engine 210 to produce the exhaust gas delivered to any one or more of the cylinders 202 of the engine. It may also recirculate exhaust gas back to itself, as illustrated in FIG. 2.

EGR system power is delivered to the crankshaft (not shown) of the primary engine 210 through a traditional reciprocating assembly. The mass flow rate of EGR delivered to the engine 210 is controlled by EGR valve 203.

In an alternative configuration (not shown), the EGR path to cylinder 201 could be separately controlled, such that cylinder 201 is capable of receiving an amount of recirculated exhaust gas different from that of cylinders 202 or of receiving no recirculated exhaust gas (fresh air only). The composition of the exhaust gas is controlled by the fuel delivery and control system associated with cylinder 201.

FIG. 2 shows EGR device 201 as having a cylinder 201 that is the same size as the other cylinders 202 of engine 210. In other embodiments, cylinder 201 may be made larger or smaller to optimize the emissions reduction and engine performance.

In FIG. 2, the secondary (EGR-producing) combustion device is "integral" to the primary engine, in the sense that it is similar to the other combustion devices (cylinders) of the engine. It shares major structural and operational components and is attached directly to the power transmission shaft of the primary engine. In contrast, in FIG. 1, the secondary combustion device is "auxiliary" to the primary engine. It is attached indirectly to the power transmission shaft of the primary engine, through gearing, belt, electrical, hydraulic, or other means of power transmission.

A common feature of both EGR system 100 and 200 is that they each have a secondary combustion device 114 or 201 with at least one piston/cylinder. This combustion device provides exhaust gas to the fresh air inlet of a primary combustion engine. The secondary combustion device can be any two or four stroke internal combustion device. It can operate at lean burn or near stoichiometric conditions.

EGR system 100 or 200 may use the same fuel as the primary engine, in which case the fuel typically comes from a common fuel reservoir or other fuel source. Or, it may use a different fuel from a different fuel source. For example, referring to FIG. 1, EGR device 114 could be gasoline-fueled, whereas engine 110 could be diesel-fueled.

Figure 1A:
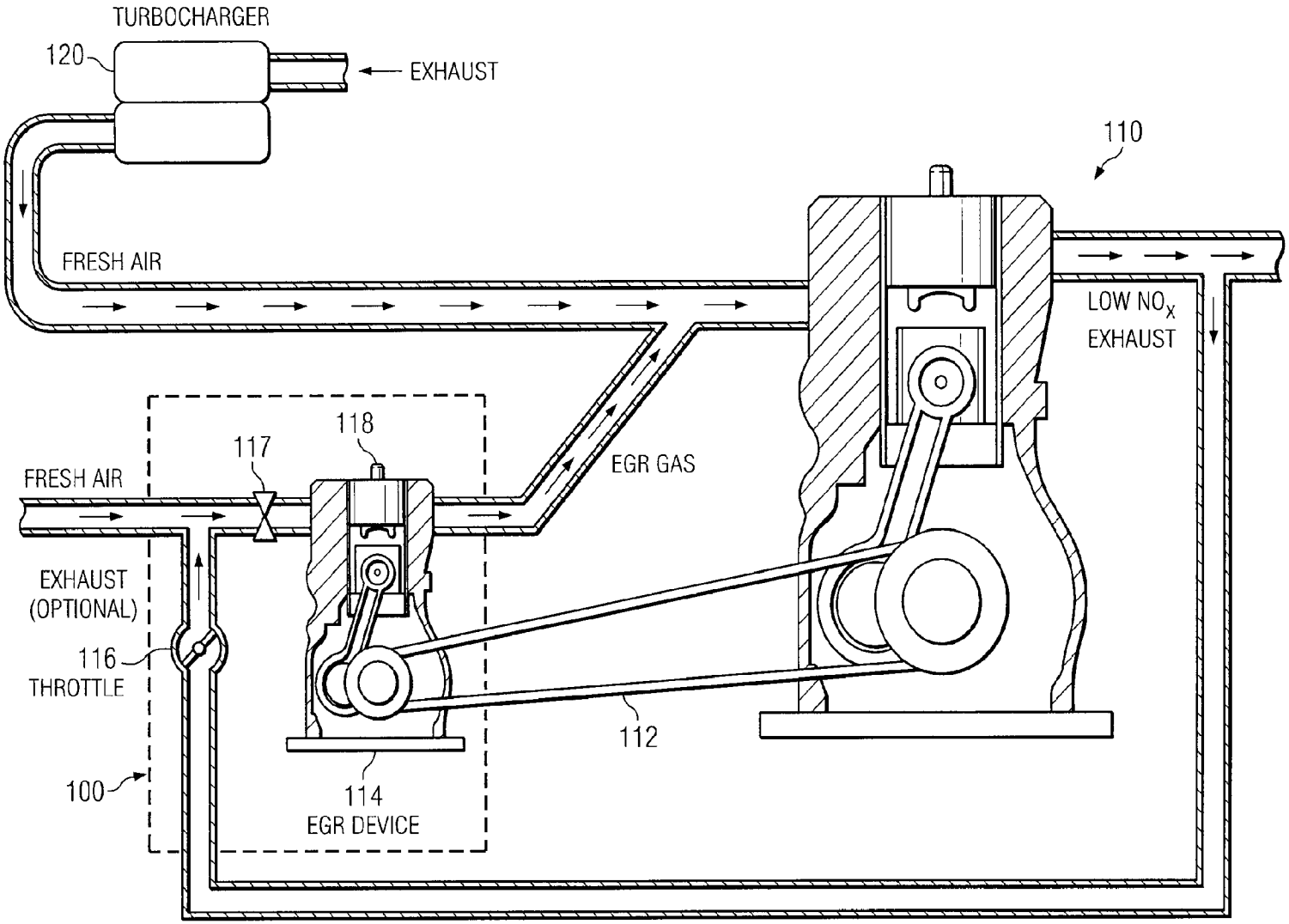

In the configuration of either FIG. 1 or 2, it is also possible to provide boost air to the EGR device. For example in FIG. 2, boost air could be delivered to EGR device 201 from the turbocharger 211. This would permit a reduction in size of the EGR device 201 for a desired delivery rate of exhaust gas to engine 210. The EGR device 114 could also be naturally aspirated as shown in FIG. 1A.

Through use of a separately controlled combustion system to produce EGR and the required mass flow rate, no negative engine pressure gradient is required for the primary combustion engine. Hence, EGR delivery is accomplished, while maintaining a more fuel efficient pressure ratio for the primary combustion engine.

If the EGR-producing system is operated at an air-fuel ratio closer to stoichiometry than the primary combustion system, the composition of the resultant EGR gas can be made to be oxygen-depleted. This provides a "higher quality" EGR gas, which provides maximum NOx reduction effectiveness for the primary combustion system. By producing EGR in a separate combustion system, the primary engine can be tuned for a better tradeoff of NOx emissions reduction versus engine efficiency.

Furthermore, by producing EGR in a secondary combustion system, the secondary combustion system can be operated at conditions that provide optimal EGR composition.

Traditional EGR delivery systems require the entire engine working fluid to be pressurized to a level high enough to create the desire EGR flow. Because the total EGR mass flow requirement is a fraction of the overall engine mass flow rate, the proposed EGR delivery technique offers pumping efficiency advantages because only the EGR mass delivered is pressurized.

The EGR-generating system provides positive power output that may be used for auxiliary power purposes, direct input, or transmitted input to the primary engine driveline.

The efficiency advantages possible through use of the above-described EGR system can be mathematically calculated. The following equation represents a general estimate for the power required to pump a known volume of gas against a pressure gradient:

$$\dot{W}_P \approx \dot{V}\Delta P$$

where $\dot{W}_P$ is required power (rate of work), $\dot{V}$ is volume of flow rate, and $\Delta P$ is pressure change. The required power estimate set out above can be applied to various EGR configurations.

Conventional High-Pressure-Loop EGR-Equipped Diesel Engine

The following calculations are for a conventional High-Pressure-Loop (HPL) EGR-equipped diesel engine, such as engine of FIG. 2. The EGR stream is extracted upstream of a turbine and introduced to the engine inlet downstream of the compressor. At peak torque operating conditions (1200 rpm, full-load, boost=3 atm), a typical, 12 liter displacement, the engine's total airflow rate is approximated by:

$$\dot{V} \approx (12\,\mathrm{L})\left(\frac{.001m^3}{1\,\mathrm{L}}\right)\left(\frac{1200\,\mathrm{rpm}}{2\times 60}\right)\left(\frac{3.0\,\mathrm{atm}}{1\,\mathrm{atm}}\right) = 0.36\frac{m^3}{\mathrm{sec}}$$

The adverse engine cylinder-head pressure gradient necessary to produce reliable and controllable EGR flow is approximately 10 to 20 kPa. Thus, the power required to pump the necessary EGR is:

$$\dot{W}_P \approx 7.2 \text{ to } 10.8 \text{ KW}$$

For a conventional, non-EGR engine, the positive cylinder-head pressure gradient is approximately 20 to 30 Kpa in the opposite direction, which provides exceptional fuel economy. Thus, the total power requirement to produce the needed engine cylinder-head pressure level at peak torque conditions for a heavy duty diesel engine is the sum of the conventional positive pressure gradient and the required gradient for pumping EGR, giving a total pressure step of 40-60 Kpa.

The pumping work difference between a conventional non-EGR engine and a HPL-EGR engine can be approximated as:

$$\dot{W}_P \approx 14.4 \text{ to } 21.6 \text{ KW}$$

for an engine with total power output at peak torque conditions of approximately 200 KW.

Conventional Low-Pressure-Loop EGR-Equipped Diesel Engine

The following calculations are for a conventional Low-Pressure-Loop (LPL) EGR-equipped diesel engine, where the EGR is extracted upstream of the turbine and introduced to the engine inlet upstream of the compressor. The LPL EGR system allows the engine to run at an advantageous pressure ratio, thus providing good engine thermal efficiency. However, the EGR delivered must be compressed from near atmospheric to compressor boost levels of approximately 3 atmospheres.

$$\Delta P \approx 3\,\text{atm} - 1\,\text{atm} = 2\,\text{atm}$$

$$\dot{W}_p \approx 0.036\frac{m^3}{\text{sec}} \times 202650Pa = 7295.4\,\text{W} = 7.3KW$$

Often, it is argued that the compressor work for turbocharged engines is derived solely from wasted exhaust energy. Therefore, for the current calculations, it is assumed that the LPL-EGR system requires between 0.0 and 7.3 KW of power.

LPL-EGR systems introduce durability concerns, because the EGR gas must be passed through the fresh air intercooler and the compressor of the engine. Hence, alternatives to the LPL-EGR system are needed.

Proposed EGR System: 4-Stroke EGR Delivery System Operated near Stoichiometry

The following calculations are for the EGR delivery system 100 or 200, applied to a typical diesel engine, where the EGR is produced utilizing a small, 4-stroke combustion cycle, operating at stoichiometric air-fuel ratios. The required EGR delivery rate is reduced compared to the traditional engine, because of the oxygen-depleted quality of the EGR. The total EGR gas volume delivered is about ⅗ of the conventional engine because of the air-fuel ratio differences in the EGR production combustion process. More specifically, for a conventional engine at AF=25 and EGR device at AF=15, the EGR mass flow requirement of the proposed EGR engine is ⅗ of the conventional engine.

$$\dot{V}_{X-EGR\,Flow} \approx 0.036\frac{m^3}{\text{sec}} \times \frac{3}{5} = 0.0216\frac{m^3}{\text{sec}}$$

If naturally aspirated, and geared to twice crankshaft speed, the required displacement of the EGR device is represented as:

$$D_{X-EGR} \approx \frac{\dot{V}}{\left(\frac{.001m^3}{1\,\text{L}}\right)\left(\frac{2400\,\text{rpm}}{2\times 60}\right)\left(\frac{1\,\text{atm}}{1\,\text{atm}}\right)} = 1.08\,\text{L}$$

If the EGR device thermal efficiency is approximated at 25% to reflect an efficiency similar to modern spark-ignited engines, the EGR system crankshaft work compared to the work that could have been delivered by the same fuel in the primary 200 KW diesel engine (assumed 40% thermal efficiency) is:

$$P_{loss} \approx 200KW \times \left(\frac{0.40 - 0.25}{0.40} \times \frac{0.0216}{.036}\right) = 4.5KW$$

Thus, the EGR system 100 or 200 penalizes the primary engine by about 4.5 KW, whereas conventional HPL-EGR delivery penalizes the engine by 14.4 to 21.6 KW.

Proposed EGR System: 2-Stroke EGR Delivery System Operated near Stoichiometry

The following calculations are for EGR system 100 or 200, applied to a typical diesel engine, where the EGR is produced utilizing a small, 2-stroke combustion cycle, operating at stoichiometric air-fuel ratios. As with the four-stroke example, the required EGR delivery rate is reduced compared to the traditional engine, because of the oxygen-depleted quality of the EGR. The total EGR gas volume delivered is about ⅗ of the conventional engine because of the air-fuel ratio differences in the EGR production combustion process.

$$\dot{V}_{X-EGR\,Flow} \approx 0.036\frac{m^3}{\text{sec}} \times \frac{3}{5} = 0.0216\frac{m^3}{\text{sec}}$$

The two-stroke EGR device moves about twice the gas volume as that of a 4-stroke. Additionally, it is assumed that the air inlet to the EGR device receives boost air from the primary engine's compressor. So with that boost and geared to twice crankshaft speed, the required displacement of the two-stroke EGR device is:

$$D_{X=EGR} \approx \frac{\dot{V}}{\left(\frac{.001m^3}{1\,\text{L}}\right)\left(\frac{2400\,\text{rpm}}{60}\right)\left(\frac{3\,\text{atm}}{1\,\text{atm}}\right)} = 0.18\,\text{L}$$

which shows that the EGR device displacement can be reduced to a size that would easily be producible as a retrofit auxiliary system.

Proposed EGR System: 4-Stroke EGR Delivery System Operated Lean-Burn

The following calculations are for the proposed EGR delivery system, applied to a typical diesel engine, where the EGR is produced utilizing a small, 4-stroke combustion cycle, operating at a lean-burn 25/1 air-fuel ratio. The required EGR delivery rate is assumed to be the same as that for the previous calculations for a conventional EGR diesel engine at 10% EGR rate:

$$\dot{V}_{X-EGR\,Flow} \approx 0.036\frac{m^3}{\text{sec}}$$

If naturally aspirated, and geared to twice crankshaft speed, the required displacement of the EGR device is:

$$D_{X-EGR} \approx \frac{\dot{V}}{\left(\frac{.001m^3}{1\,\text{L}}\right)\left(\frac{2400\,\text{rpm}}{2\times 60}\right)\left(\frac{1\,\text{atm}}{1\,\text{atm}}\right)} = 1.8\,\text{L}$$

If the EGR device thermal efficiency is approximated at 35%, to reflect an efficiency similar to modern diesel engines with adverse pressure gradients. An adverse pressure gradient is assumed so that the EGR device can "pump" EGR into the primary combustion system.

The EGR system crankshaft work compared to the work that could have been delivered by the same fuel in the primary 200 KW diesel engine (assumed 40% thermal efficiency) is:

$$P_{loss} \approx 200KW \times \left(\frac{0.40-0.35}{0.40} \times \frac{0.0216}{0.36}\right) = 2.5KW$$

Thus, the proposed EGR delivery device would require about 2.5 KW, where conventional systems require 14.4 to 21.6 KW.

Benefits of EGR with Secondary Combustion

As illustrated above, the primary benefit is the ability to provide NOx emissions reductions at fuel consumption levels much better than conventional EGR engines. The estimated reduction in fuel consumption penalty for an EGR engine is:

$$\text{Conventional } EGR \text{ Penalty} \approx \frac{14.4KW}{200KW} \text{ to } \frac{21.6KW}{200KW} = 7.2\% \text{ to } 10.8\%$$

$$\text{Proposed System } EGR \text{ Penalty} \approx \frac{2.5KW}{200KW} \text{ to } \frac{4.5KW}{200KW} = 1.25\% \text{ to } 2.25\%$$

What is claimed is:

1. A method for providing exhaust gas to a lean burn diesel-fueled primary internal combustion engine having an EGR loop, an air boost device that delivers boost air via a charged air intake line, and a power crankshaft, for use by the engine to reduce NOx emissions, comprising:

using a secondary internal combustion device to produce exhaust gas;

wherein the secondary internal combustion device is separate from and auxiliary to the diesel-fueled primary internal combustion engine;

wherein the secondary internal combustion device is operated at near stoichiometric combustion conditions;

delivering substantially all of the exhaust from the secondary internal combustion device to only the diesel-fueled primary internal combustion engine, such that the diesel-fueled primary internal combustion engine receives a mixture of boosted fresh air and the exhaust from the secondary internal combustion device;

the delivering step being performed by delivering the exhaust to an entry point on the charged air intake line;

driving a secondary crankshaft with the secondary internal combustion engine;

transferring power from the secondary crankshaft to the power crankshaft;

operating the secondary crankshaft at a higher speed than the power crankshaft; and determining the amount of exhaust delivered from the secondary internal combustion device to the diesel-fueled primary internal combustion engine at least in part by means of the gearing of the secondary crankshaft.

2. A method for providing exhaust gas to a lean burn diesel-fueled primary internal combustion engine having an EGR loop, an air boost device that delivers boost air via a charged air intake line, and a power crankshaft, for use by the engine to reduce NOx emissions, comprising:

using a secondary internal combustion device to produce exhaust gas;

wherein the secondary internal combustion device is separate from and auxiliary to the diesel-fueled primary internal combustion engine;

wherein the secondary internal combustion device is operated at near stiochiometric combustion conditions;

diverting a portion of the boost air from the air boost device to the secondary internal combustion device, at an exit point on the charged air intake line;

delivering substantially all of the exhaust from the secondary internal combustion device to only the diesel-fueled primary internal combustion engine, such that the diesel-fueled primary internal combustion engine receives a mixture of boosted fresh air and the exhaust from the secondary internal combustion device;

the delivering step being performed by delivering the exhaust to an entry point on the charged air intake line and downstream the exit point;

driving a secondary crankshaft with the secondary internal combustion engine;

transferring power from the secondary crankshaft to the power crankshaft;

operating the secondary crankshaft at a higher speed than the power crankshaft; and determining the amount of exhaust delivered from the secondary internal combustion device to the diesel-fueled primary internal combustion engine at least in part by means of the gearing of the secondary crankshaft.

3. The method of claim 2, further comprising controlling the composition of the exhaust gas provided by the secondary internal combustion device by controlling the fuel delivered to the secondary internal combustion device.

* * * * *